United States Patent [19]
Opresko

[11] Patent Number: 4,649,317
[45] Date of Patent: Mar. 10, 1987

[54] MULTIBEAM ELECTRON GUN HAVING MEANS FOR SUPPORTING A SCREEN GRID ELECTRODE RELATIVE TO A MAIN FOCUSING LENS

[75] Inventor: Stephen T. Opresko, Manor Township, Lancaster County, Pa.

[73] Assignee: RCA Corporation, Princeton, N.J.

[21] Appl. No.: 769,970

[22] Filed: Aug. 27, 1985

[51] Int. Cl.[4] ..... H01J 29/50; H01J 29/82
[52] U.S. Cl. ..... 313/414; 313/417; 313/451; 313/457
[58] Field of Search ..... 313/417, 448, 456, 457, 313/451, 447, 414, 446

[56] References Cited

U.S. PATENT DOCUMENTS

| | | | |
|---|---|---|---|
| 4,298,818 | 11/1981 | McCandless | 313/417 |
| 4,500,808 | 2/1985 | McCandless | 313/409 |
| 4,520,292 | 5/1985 | van Hekken et al. | 313/412 |
| 4,558,254 | 12/1985 | Opresko | 313/446 |

OTHER PUBLICATIONS

U.S. Patent Application Ser. No. 643,175, entitled, "Multibeam Electron Gun Having a Cathode-Grid Subassembly and Method of Assembling Same", filed on Aug. 22, 1984, by McCandless et al.
U.S. Patent Application Ser. No. 643,314, entitled, "Structure for and Method of Aligning Beam-Defining Apertures by Means of Alignment Apertures", filed on Aug. 22, 1984, by S. T. villanyi.
U.S. Patent Application Ser. No. 735,261, entitled, "Multibeam Electron Gun Having a Transition Member and Method for Assembling the Electron Gun", filed on May 17, 1985, by H. E. McCandless.

*Primary Examiner*—Palmer C. DeMeo
*Attorney, Agent, or Firm*—Eugene M. Whitacre; Dennis H. Irlbeck; Vincent J. Coughlin, Jr.

[57] ABSTRACT

An electron gun for a cathode-ray tube comprises a modular beam-forming region assembly and a main focusing lens which are affixed to at least two insulative support rods. The modular beam-forming region assembly includes a plurality of cathode assemblies, a control grid electrode and a screen grid electrode. The control grid electrode and the screen grid electrode are attached to a first major surface, of a common ceramic member and the cathode assemblies are attached to a second major surface thereof. A transition member is disposed between a metallized pattern on the first major surface of the ceramic member and the screen grid electrode. The transition member includes a substantially flat portion attached to the metallized pattern and two upright portions substantially perpendicular to the flat portion and substantially parallel to each other. The screen grid electrode is disposed between the upright portions and connected thereto by a plurality of step-like support members. Each of the step-like support members includes a screen grid electrode contact portion, a bead support contact portion and a central riser portion extending between the contact portions. The screen grid electrode contact portion of each step-like support member is attached to the screen grid electrode. The bead support contact portion of each step-like support member is attached to a different one of a plurality of bead support members affixed to the insulative support rods, whereby the screen grid electrode is longitudinally spaced from the main focusing lens.

3 Claims, 5 Drawing Figures

MULTIBEAM ELECTRON GUN HAVING MEANS FOR SUPPORTING A SCREEN GRID ELECTRODE RELATIVE TO A MAIN FOCUSING LENS

BACKGROUND OF THE INVENTION

The present invention relates to an improved multibeam electron gun for a cathode-ray tube and particularly to an electron gun having a modular beam-forming region (BFR) assembly comprising a plurality of cathode assemblies, a control grid (G1) electrode and a screen grid (G2) electrode. The electrodes have aligned apertures and are attached to a common ceramic support member. The screen grid electrode is positioned relative to the control grid electrode by support means which also accurately locates the BFR assembly relative to a main focusing lens of the electron gun.

U.S. Pat. No. 4,298,818 issued to McCandless on Nov. 3, 1981, discloses an electron gun having a modular beam-forming region (BFR) assembly similar to that of the present invention in that it also comprises a plurality of cathode assemblies and at least two successive electrodes including a control grid (G1) electrode and a screen grid (G2) electrode. Unlike the present invention, the successive electrodes of the patented beam-forming region are individually attached directly to metallized patterns on the surface of a common ceramic support member. The longitudinal spacing between the G1 and G2 electrodes is determined by the flange heights of the electrodes. A support bracket is embedded into the glass support rods of the electron gun in spaced relation to a main focusing lens. The screen grid electrode is welded to the support bracket to secure the modular BFR assembly in spaced relation to the main focusing lens. A drawback of the patented electron gun is that irregularities on the surface of the support ceramic or variations in the heights of the flange portions of the control grid or screen grid electrodes will cause variations in the longitudinal spacing between the successive electrodes. Proper operation of a multibeam cathode-ray tube utilizing such an electron gun requires that the spacing and alignment between the successive electrodes of the BFR assembly be accurately maintained. Apertures that are misaligned by as little as 0.0127 mm (0.5 mils) can cause distorted beam shapes and degrade the performance of the tube.

U.S. Pat. No. 4,500,808 issued to McCandless on Feb. 19, 1985, describes an improved electron gun similar to that of U.S. Pat. No. 4,298,818, except that the screen grid (G2) electrode of the modular beam-forming region (BFR) assembly comprises a composite structure including a metal support plate and three individual apertured plates. The metal support plate is brazed directly to a metallized pattern on one surface of a ceramic support member in spaced relation to a control grid (G1) electrode which is also brazed directly to a separate metallized pattern on the same surface of the ceramic support member. The metal support plate has a window therein opposite each of the apertures in the control grid electrode. The individual apertured plates are brazed to the metal support plate and close the windows therein. Each of the apertured plates has a single electron beam-defining aperture therein which is separately aligned with one of the apertures in the control grid (G1) electrode. This structure provides more accurate alignment of the G1 and G2 electrode apertures than previous structures; however, the longitudinal spacing between the G1 and G2 electrodes continues to depend on the flatness of the surface of the ceramic member and the flange heights of the G1 and G2 electrodes. Additionally, the longitudinal spacing between the screen grid (G2) electrode and the main focusing lens depends upon the thickness and flatness of the individual apertured plates brazed to the metal support plate of the G2 electrode.

An improved modular BFR assembly for an electron gun is described in U.S. patent application No. 769,978 filed by A. K. Wright on Aug. 27, 1985 entitled, "MULTIBEAM ELECTRON GUN HAVING MEANS FOR POSITIONING A SCREEN GRID ELECTRODE", assigned to the assignee of the present application. The electron gun of that application includes a modular BFR assembly and a main focus lens, both of which are affixed to a pair of insulative support rods. The BFR assembly includes a plurality of cathode assemblies, a control grid (G1) electrode and a screen grid (G2) electrode. The main focus lens includes a first focusing (G3) electrode and a second focusing (G4) electrode. The cathode assemblies and the G1 and G2 electrodes are individually held in position from a common ceramic member. A transition member having a flat first part and a second part electrically isolated from the first part is attached to a metallized pattern formed on one surface of the ceramic member. The second part of the transition member has a flat portion brazed to the metallized pattern and two upright portions that are substantially perpendicular to the flat portion and parallel to each other. The G1 electrode is attached to the first part of the transition member, and the G2 electrode is disposed between and attached to the upright portions of the second part of the transition member by means of a plurality of L-shaped support members. The longitudinal spacing between the G1 and G2 electrodes is set by means of a removable spacer. Each L-shaped support member has one end welded to the surface of the G2 electrode adjacent to the G3 electrode, and the other end welded to the upright support portions of the transition member. The upright support portions of the transition member permit a greater range in positioning the G2 electrode longitudinally in spaced relation to the G1 electrode than was available heretofore when each electrode was a precision formed part. The L-shaped supports allow the G2 electrode to be narrower than the width between the upright portions of the transition member so that the G2 electrode can be laterally positioned to align the electron beam-forming apertures with the corresponding apertures in the G1 electrode. The BFR assembly of patent application reduces the precision with which the G1 electrode and the surface of the ceramic member must be made, since the upright portions of the transition member provide a longitudinal tolerance not available in the prior electron guns described heretofore. A drawback of structure, however, is that since the BFR assembly is attached to the glass support rods by metal bead support members affixed at one end to the glass support rods and at the other end to the flat portion of the second part of the transition member, the spacing between the G2 and G3 electrodes in indirectly established with relation to the flat portion of the transition member. Thus, if the height of the G1 electrode or the flatness of the surface of the ceramic support member were to vary beyond the optimum range, corresponding variations in the location of the G2 electrode to maintain the G1 to G2 longitudinal spacing would result in an inverse variation in the G2 to G3 longitudinal spacing. The ends of the bead support members attached to the transition flange of the BFR assembly can be bent to provide the required G2 to G3 electrode spacing; however, such an expedient can cause cracking of the glass support rods or a subsequent change in G2–G3 electrode spacing as a result of the restorative force in the metal bead support members. An alternative is to provide electron guns having the bead support members attached to the glass support rods with a range of spacings between the ends of the bead support members and the G3 electrode to compensate for variations in the location of the G2 electrode. This is not practical in a high volume operation.

SUMMARY OF THE INVENTION

The novel electron gun for a cathode-ray tube comprises a modular beam-forming region assembly and a main focusing lens which are affixed to at least two insulative support rods. The modular beam-forming region assembly includes a plurality of cathode assemblies, a control grid electrode and a screen grid electrode. The electrodes have aligned apertures therethrough for passage of a plurality of electron beams from the cathode assemblies. The cathode assemblies and the electrodes are individually held in position from a common ceramic member. The ceramic member has a first major surface and an oppositely disposed second major surface with a metallized pattern formed on at least a portion of each major surface. The control grid electrode and the screen grid electrode are attached to the first major surface, and the cathode assemblies are attached to the second major surface. A transition member is disposed between the metallized pattern on the first major surface of the ceramic member and the screen grid electrode. The transition member includes a substantially flat portion attached to the metallized pattern and two upright portions substantially perpendicular to the flat portion and substantially parallel to each other. The screen grid electrode comprises at least one plate-like member disposed between the upright portions and connected thereto by a plurality of step-like support members. Each of the step-like support members includes a screen grid electrode contact portion, a bead support contact portion and a central riser portion extending between the aforementioned contact portions. The screen grid electrode contact portion of each step-like support member is attached to the screen grid electrode. The screen grid electrode is longitudinally spaced from the control grid electrode, and the central riser portion of each step-like support member is attached to the upright portions of the transition member. The bead support contact portion of each step-like support member is attached to a different one of a plurality of bead support members affixed to the insulative support rods, whereby the screen grid electrode is longitudinally spaced from the main focusing lens.

DETAILED DESCRIPTION OF THE PREFERRED EMBODIMENT

Figure 1:
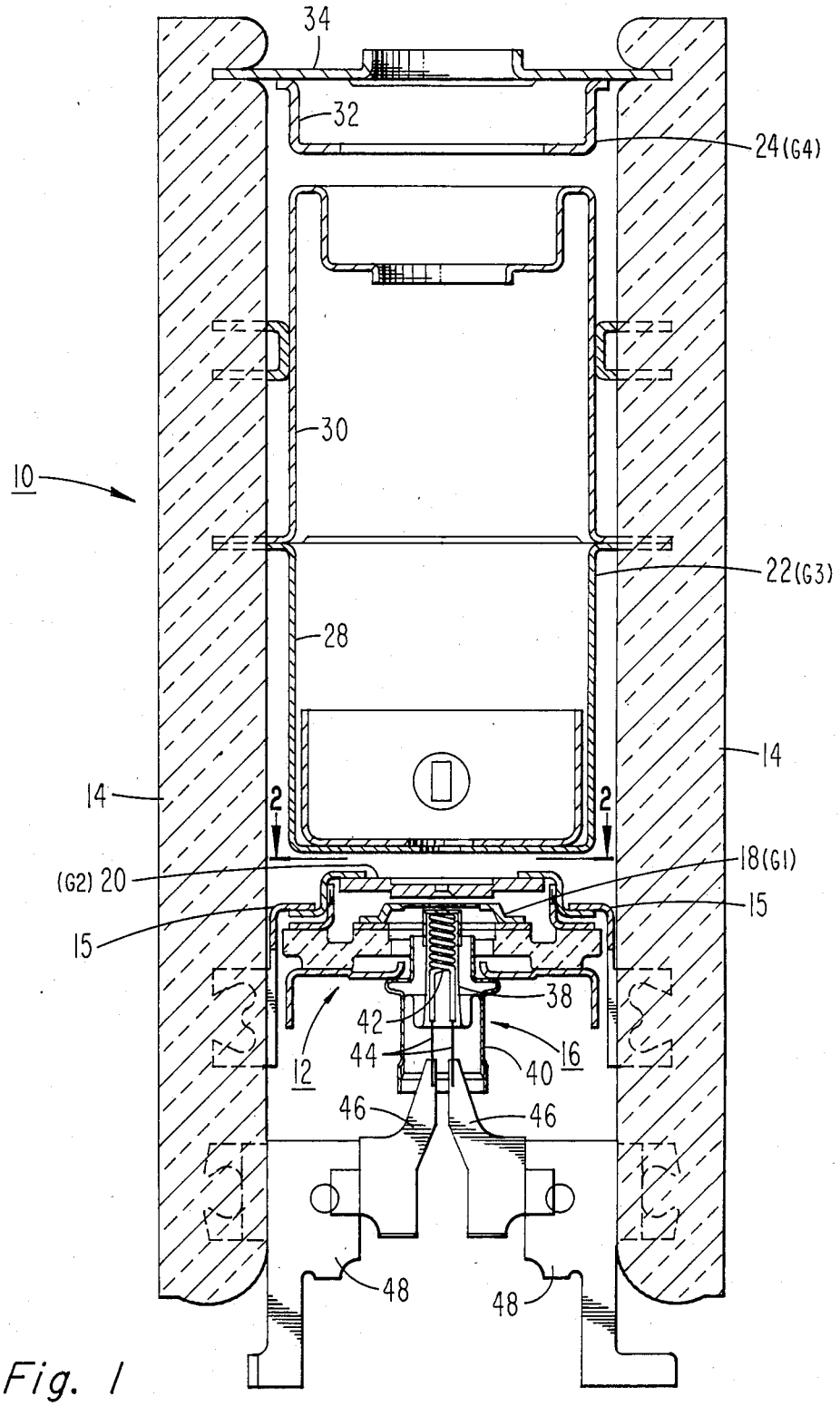
FIG. 1 is a partially cut-away, side elevational view of a preferred embodiment of the novel electron gun.

As shown in FIG. 1, an improved electron gun 10 includes a modular beam-forming region (BFR) assembly 12 secured to a pair of glass support rods 14, also called beads, by a plurality of metal bead support members 15. The modular BFR assembly 12 includes three equally spaced inline cathode assemblies 16, one for each electron beam (only one of which is shown in the view of FIG. 1), a control grid (G1) electrode 18 and a screen grid (G2) electrode 20. Longitudinally spaced from the BFR assembly 12 is a main focusing lens comprising a first focusing (G3) electrode 22 and a second focusing (G4) electrode 24.

The first focusing electrode 22 comprises a substantially rectangularly cup-shaped lower first member 28 and a similarly shaped upper first member 30 joined together at their open ends. The closed ends of the members 28 and 30 have three apertures therethrough, although only the center apertures are shown in FIG. 1. The apertures in the first focusing electrode 22 are aligned with the apertures in the control and screen grid electrodes 18 and 20. The second focusing electrode 24 comprises a rectangularly cup-shaped member 32 and an apertured plate member 34. Three inline apertures also are formed in the ends of the members 32 and 34.

Each of the cathode assemblies 16 comprises a substantially cylindrical cathode sleeve 38 closed at the forward end and having an electron emissive coating (not shown) thereon. The cathode sleeve 38 is supported at its open end within a cathode eyelet 40. A heater coil 42 is positioned within the sleeve 38 in order to indirectly heat the electron emissive coating. The heater coil 42 has a pair of legs 44 which are welded to heater straps 46 which, in turn, are welded to support studs 48 that are embedded in the glass support rods 14.

Figure 2:
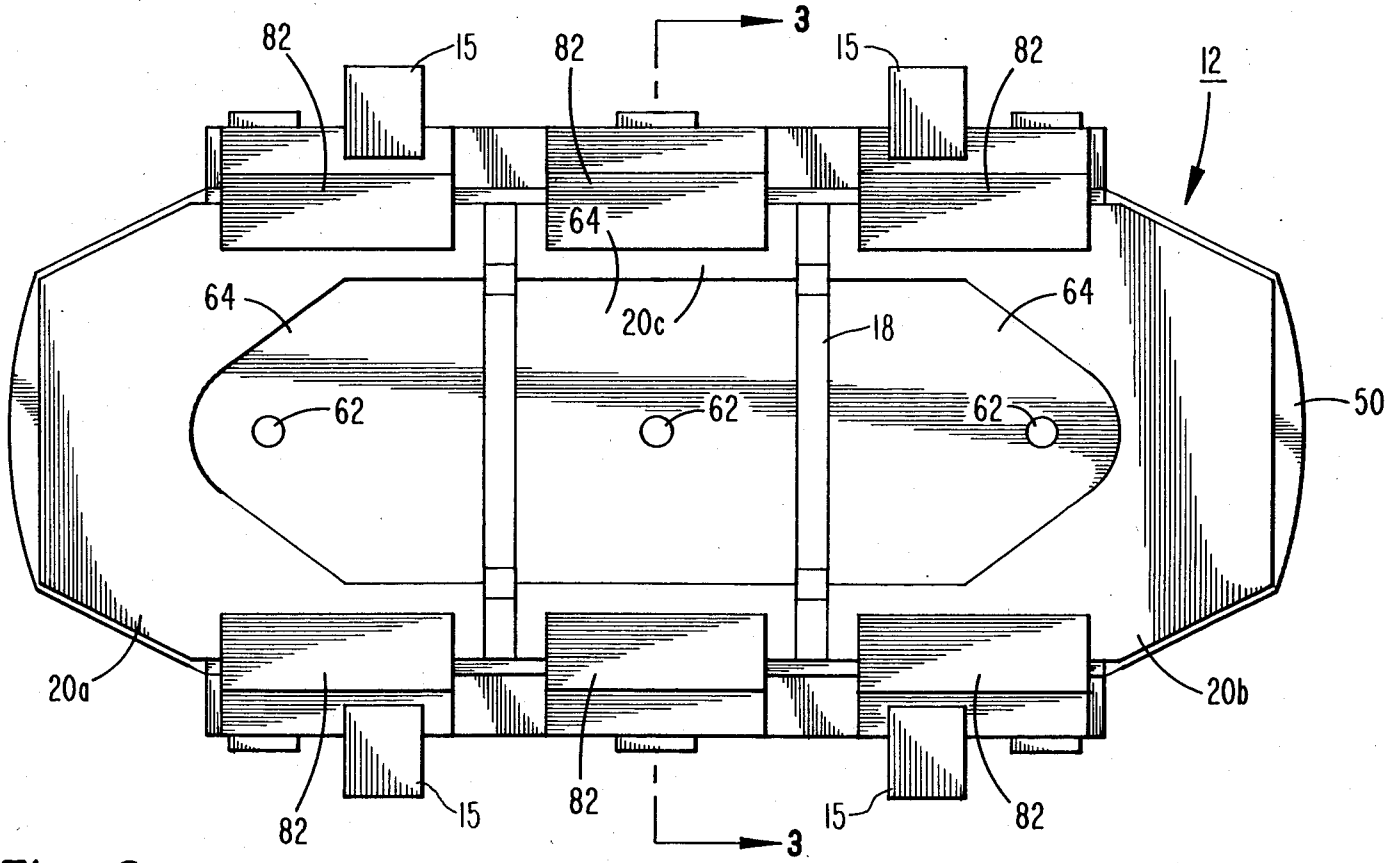
FIG. 2 is an enlarged plan view of the BFR assembly of the electron gun taken along line 2—2 of FIG. 1.
Figure 3:
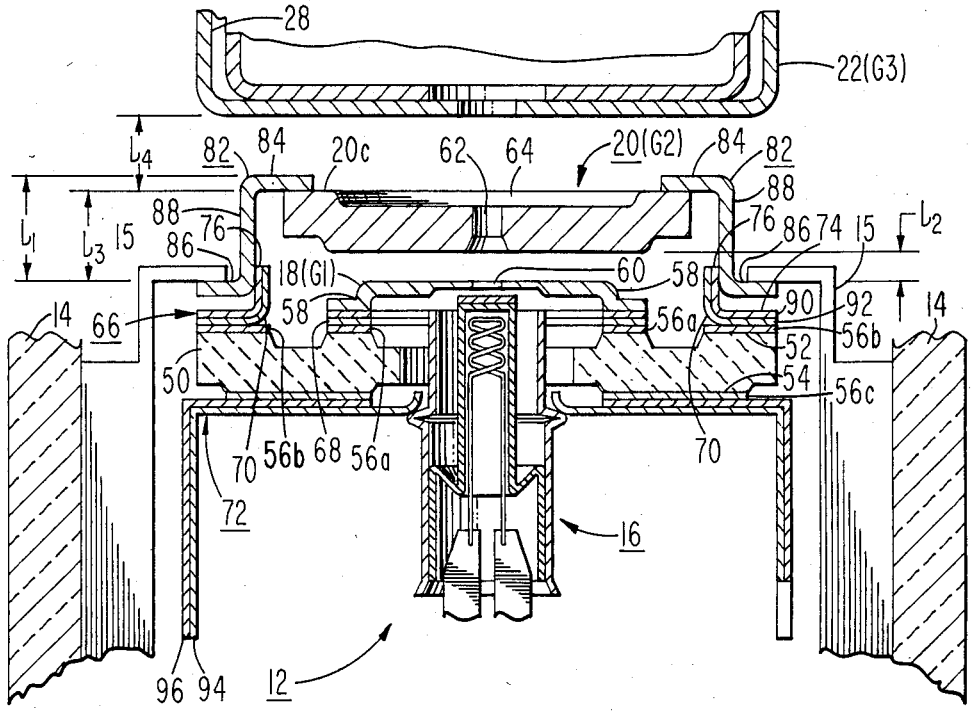
FIG. 3 is a sectional view of the BFR assembly taken along line 3—3 of FIG. 2.

The modular BFR assembly 12, shown in FIGS. 2 and 3, includes a ceramic member 50, having an alumina content of about 99%, to which the cathode assemblies 16 and the control grid and screen grid electrodes 18 and 20 are attached. The ceramic member 50 includes a first major surface 52 and an oppositely disposed substantially parallel second major surface 54. The ceramic member has a thickness of about 1.5 mm (0.06 inch). At least a portion of the first major surface 52 has metallizing patterns **56*a* and 56*b* formed thereon to permit attachment thereto of the electrodes 18 and 20, respectively. The metallized patterns 56*a* and 56*b* comprise discrete areas that are electrically isolated from each other. A plurality of electrically isolated metallizing patterns (only one of which, 56*c*, is shown) are provided on the second major surface 54 to permit attachment of the cathode assemblies 16 thereto. The metallizing of a ceramic member is well known in the art and needs no further explanation. The major surfaces 52 and 54 may include lands, as shown in FIG. 3, which facilitate application of the electrically isolated metallizing patterns thereto. The control grid electrode 18 is essentially a flat plate having two parallel flanges 58 on opposite sides of the three inline, precisely spaced, beam-defining apertures 60, only one of which is shown. The screen grid electrode 20 may comprise three separate plate-like portions each of which has a beam-defining aperture 62 therethrough, or a single plate with three precisely located apertures may be used. The outer portions of the screen grid electrode 20 are designated 20*a* and 20*b* and the center portion is designated 20*c*. A recess 64 is formed in the surface of the screen grid electrode 20 that is adjacent to the lower first member 28 of the first focusing electrode 22. The recess 64 provides a horizontal convergence correction of the outer electron beams to compensate for changes in focus voltage. This structure is described in U.S. Pat. No. 4,520,292 issued to van Hekken et al. on May 28, 1985, and is incorporated by reference herein for the purpose of disclosure. The separate portions 20***a*, 20*b* and 20*c* of the screen grid electrode 20 can be individually positioned so that the apertures 62 in the screen grid electrode 20 are aligned with the corresponding apertures 60 in the control grid electrode 18.

In U.S. Pat. Nos. 4,298,818 and 4,500,808 the control and screen grid electrodes are brazed directly to the metallized patterns on the ceramic surfaces. The brazing of a plurality of formed metal parts tends to distort at least some of the parts and introduce stress into the ceramic member. If the stress is sufficiently great, the ceramic member will crack, rendering the cathode-grid assembly unusable.

U.S. patent application, Ser. No. 735,261 filed on May 17, 1985 by McCandless and assigned to the assignee of the present invention, discloses a substantially flat, bimetal transition member which is brazed to the metallized pattern on the ceramic member. The control and screen grid electrodes are then welded to the transition member. The thickness of the transition member is limited to about 20% of the thickness of the ceramic member so that minimal stress is introduced into the ceramic member during brazing. The McCandless patent application is incorporated by reference herein for the purpose of disclosure.

Figure 4:
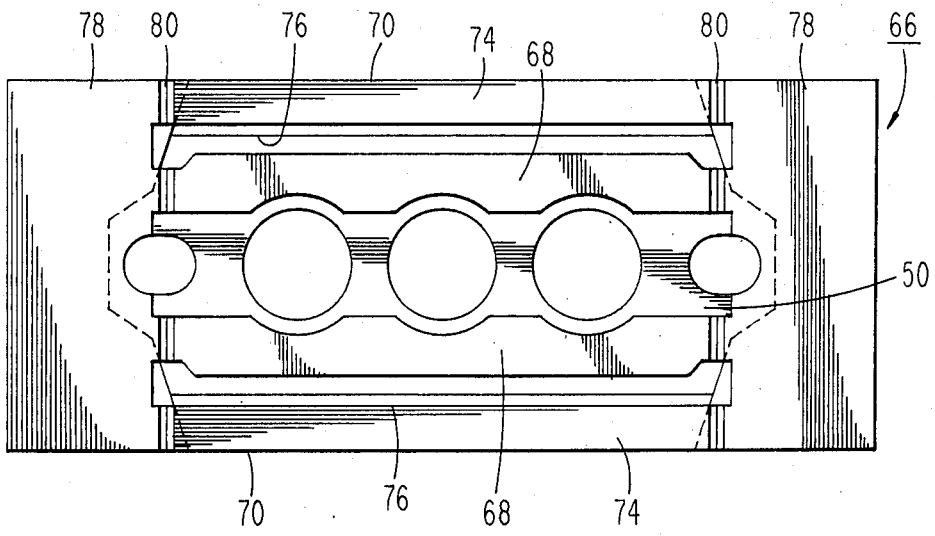
FIG. 4 is a plan view of a transition member.

As shown in FIGS. 3 and 4, a first transition member 66 having a substantially flat first part 68 and a second part 70, having an L-shaped cross-section, is brazed to metallized patterns 56*a* and 56*b* on first major surface 52 simultaneously with the brazing of a second transition member 72 to the metallizing pattern 56*c* on the second major surface 54. The second part 70 of the first transition member has a substantially flat first portion 74 in contact with the metallized pattern 56*b* and upright portions 76 which are substantially perpendicular to the flat portion 74. The first part 68 and the second part 70 of the first transition member 66 and the second transition member 72 each include a break-away frame similar to those described in the above-referenced U.S. patent application, Ser. No. 735,261. As shown in FIG. 4, the first transition member 66 includes frame portions 78 which are connected to the first and second parts 68 and 70 by V-notched bridge regions 80. Breaking away the frame portions 78 of the first transition member 66 at the bridge regions 80 electrically isolates the first part 68 and the second part 70. As shown in FIG. 3, the second part 70 of the first transition member 66 extends along both sides of the first major surface 52 of the ceramic member 50 so that the screen grid electrode 20 can be disposed between the substantially parallel upright portions 76. The control grid electrode 18 is welded to the first part 68 of the first transition member 66. The height of the upright portions 76 of the first transition member is sufficient to permit longitudinal variations in the locations of the screen grid electrode portions 20*a*, 20*b* and 20*c* to accommodate variations in the height of the control grid 18, or irregularities in the flatness of the ceramic member 50. In other words, neither the first major surface 52 of the ceramic member 50 nor the control grid electrode 18 is required to be a precision part since the plate-like screen grid electrode portions 20*a*, 20*b* and 20*c* can be longitudinally located by means of appropriate removable spacers (not shown) and laterally positioned to provide the desired spacing and alignment between the successive electrodes. At least two step-like support members 82 are secured to each of the screen grid electrode portions 20*a*, 20*b* and 20*c*, one on each side. Each of the step-like support members 82 includes a screen grid electrode contact portion 84, a bead support contact portion 86 and a central riser portion 88 of precise length, $l_1$, of about 2.0 mm. The screen grid electrode contact portions 84 are attached to the plate-like portions 20*a*, 20*b* and 20*c* of the screen grid electrode 20. The plate-like portions 20*a*, 20*b* and 20*c* are disposed between the upright portions 76 of the first transition member 66. The width of the portions 20*a*, 20*b* and 20*c* is such that the portions can be laterally positioned between the upright portions 76 so that the apertures 62 in the screen grid electrode portions 20*a*, 20*b* and 20*c* can be aligned with the apertures 60 in the control grid electrode 18. Longitudinal spacing, $l_2$, between the control grid electrode 18 and the screen grid electrode 20 is achieved by means of removable spacers (not shown) disposed therebetween. The central riser portions 88 are welded to the upright portions 76 to secure the screen grid electrode portions 20*a*, 20*b* and 20*c* in alignment with and in spaced relation to the control grid electrode 18.

In the present structure, the first and second transition members 66 and 72 comprise face-to-face laminated bimetal layers. The first transition member 66 comprises a first metal layer 90 formed from a nickel-iron alloy of 42% nickel and 58% iron. The first layer 90 has a thickness of about 0.2 mm (0.008 inch). A second metal layer 92, preferably formed of copper, has a thickness of about 0.025 mm (0.001 inch). The melting point of the copper layer 92 is about 1033° C., and the melting point of the nickel-iron layer 90 is about 1427° C. The copper layer 92 is in contact with the metallized layers 56*a* and 56*b* on the first major surface 52. The second transition member 72 also comprises a face-to-face laminated bimetal formed of a 0.2 mm thick nickel-iron layer 94 and a 0.025 mm thick copper layer 96 which is brazed directly to the metallized layer 56*c* on the second major surface 54. The BFR assembly 12 is attached to the electron gun 10 by welding the bead support members 15 to the bead support contact portions 86.

With respect to FIG. 3, the longitudinal spacing, $l_2$, between the control grid electrode 18 and the screen grid electrode 20 is established by means of spacers disposed between the electrodes 18 and 20 during the welding of the central riser portions 88 of the support member 82 to the upright portions 76 of the first transition member 66. Since each of the support members 82 is formed so that the central riser portion 88 has a precise length, $l_1$, measured from the top of the bead support contact portion 86 to the top of the screen grid electrode contact portion 84, the distance, $l_3$, from the top of the screen grid electrode 20 to the top of the bead support contact portion 86 is also precisely fixed for each BFR assembly 12. During the beading operation in which the G3 and G4 electrodes 22 and 24 are secured to the glass support rods 14, the bead support members 15 are also affixed to the support rods 14 a precise distance from the first focusing (G3) electrode 22. Thus, when the bead support contact portions 86 of the BFR assembly 12 are attached to the bead support members 15, the proper longitudinal spacing, $l_4$, between the top of the screen grid (G2) electrode 20 and the bottom surface of the first focusing (G3) electrode 22 is established without having to bend or otherwise deform the bead support members 15.

Figure 5:
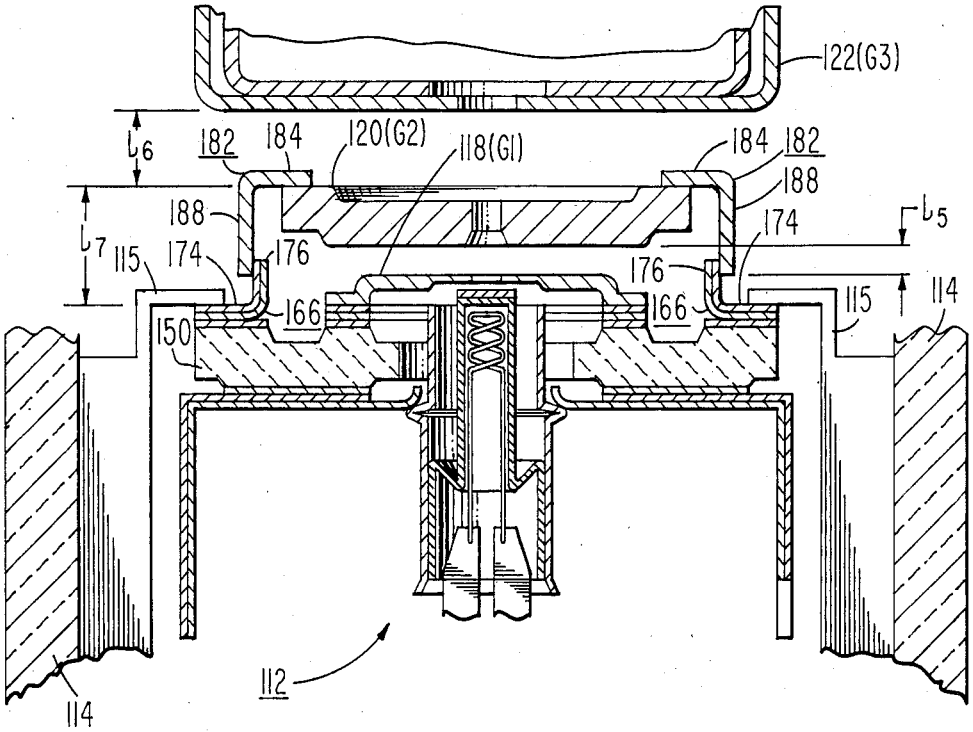
FIG. 5 is a sectional view of another BFR assembly.

FIG. 5 shows a modular BFR assembly 112 that is disclosed in the above-referenced U.S. patent application 769,978. The BFR assembly 112 differs from the present BFR assembly 12 in that the BFR assembly 112 utilizes a plurality of L-shaped support members 182 to secure a screen grid (G2) electrode 120 to upright portions 176 of a first transition member 166. Each of the L-shaped members includes a screen grid electrode contact portion 184 and a transition upright contact portion 188. The BFR assembly 112 is connected to the electron gun by means of a purality of bead support members 115 which are embedded in a pair of glass support rods 114 and have their free ends welded to a flat surface 174 of the transition member 166. In this structure, as in the present novel structure, the G1 to G2 longitudinal spacing $l_5$ between a control grid (G1) electrode 118 and the screen grid (G2) electrode 120 is provided by a removable spacer (not shown). Unlike the present novel structure, however, the G2–G3 longitudinal spacing $l_6$ between the screen grid (G2) electrode 120 and a first focusing (G3) electrode 122 of the main focus lens also is established when the G1–G2 spacing is set since the bead support members 115 are attached to the surface 174 of the transition member 166. As shown in FIG. 5, when the G1–G2 spacing $l_5$ is established, the height $l_7$ of the top of the screen grid electrode 120 above the surface 174 also is established. Since the bead support members 115 are attached to the glass support rods 114 at the same time that the main electron lens is attached to the support rods 114, the total spacing between the attachment surface of the bead support members 115 and the first focusing electrode 122 is $l_6+l_7$. Clearly, if the G1–G2 spacing $l_5$ varies from the optimum range, because of variations in the surface flatness of ceramic member 150, or variations in the height of the flange of the control grid electrode 118 then $l_7$ varies directly with changes in $l_5$, and $l_6$ varies inversely with changes in $l_7$. In order to maintain the optimum G2–G3 longitudinal spacing $l_6$, a removable shim (not shown) may be placed between the top surface of the screen grid electrode 120 and the bottom surface of the first focusing electrode 122 when the bead support members 115 are welded to the surface 174 of the transition member 166. The ends of the bead support members 115 in contact with the surface 174 may be bent sufficiently to hold the shim between the facing surfaces of the screen grid electrode 120 and the first focusing electrode 122. However, such an expedient should be avoided since bending may crack the glass support beads 114. An alternative method of obtaining the optimum G2–G3 longitudinal spacing, $l_6$, is to relocate the bead support members 115 in the glass support beads 114 to compensate for variations in the G1–G2 spacing, $l_5$. This, however, requires a large number of electron guns of different spacing and is less practical than the present novel structure.

What is claimed is:

1. In a multibeam electron gun for a cathode-ray tube comprising a modular beam-forming region assembly and a main focusing lens which are affixed to at least two insulative support rods, said beam-forming region assembly including a plurality of cathode assemblies, a control grid electrode and a screen grid electrode, said electrodes having aligned apertures therethrough for passage of a plurality of electron beams from said cathode assemblies, said cathode assemblies and said electrodes being individually held in position from a common ceramic member having a first and a second major surface with a metallized pattern formed on at least a portion of each major surface, said electrodes being attached to said first major surface and said cathode assemblies being attached to said second major surface, wherein the improvement comprises a transition member disposed between said metallized pattern on said first major surface of said ceramic member and said screen grid electrode, said transition member including a substantially flat portion attached to said metallized pattern and two upright portions substantially perpendicular to said flat portion and substantially parallel to each other, said screen grid electrode having at least one plate-like member disposed between sald upright portions of said transition member, and a plurality of step-like support members interconnecting said screen grid electrode to said upright portions of said transition member, each of said step-like support members having a screen grid electrode contact portion, a bead support contact portion and a central riser portion extending between said aforementioned contact portions, said screen grid electrode contact portion of each of said step-like support members being attached to said screen grid electrode and said central riser portion of each of said step-like support members being attached to said upright portions of said transition member in longitudinal spaced relation to said control grid electrode, said bead support contact portion of each step-like support member being attached to a different one of a plurality of bead support members affixed to said insulative support rods, whereby said screen grid electrode is longitudinally spaced from said main focusing lens.

2. In a multibeam electron gun for a cathode-ray tube comprising a modular beam-forming region assembly and at least one main focusing lens attached to at least two insulative support rods, said beam-forming region assembly including a plurality of cathode assemblies, a control grid electrode and a screen grid electrode, each of said electrodes having a plurality of aligned apertures therethrough for passage of electron beams from said cathode assemblies, said cathode assemblies and said electrodes being individually held in position from a common ceramic member, said ceramic member having a first major surface and an oppositely disposed second major surface with a metallized pattern formed on at least a portion of each major surface, said control grid electrode and said screen grid electrode being attached to said first major surface and said cathode assemblies being attached to said second major surface, wherein the improvement comprises a transition member attached to said metallized pattern on said first major surface of said ceramic member, said transition member including a substantially flat first part and a second part electrically isolated from said first part, said second part having a flat portion and two upright portions substantially perpendicular to said flat portion and substantially parallel to each other, said control grid electrode being attached to said first part of said transition member, said screen grid electrode comprising at least one plate-like member, and a plurality of step-like support members interconnecting said screen grid electrode and said upright portions of said second part of said transition member, each of said step-like support members including a screen grid electrode contact portion, a bead support contact portion and a central riser portion of precise length extending between said contact portions, each of said screen grid electrode contact portions being attached to said screen grid electrode, said screen grid electrode being disposed between said upright portions of said transition member, said central riser portion of each of said support members being adjacent to said upright portions of said transition member and attached thereto, whereby said screen grid electrode can be positioned laterally and longitudinally with respect to said control grid electrode and secured in alignment therewith, each of said bead support contact portions being attached to a different one of a plurality of bead support members affixed to said insulative support rods, thereby locating said screen grid electrode of said modular beam-forming region assembly in longitudinally spaced relation to said main focusing lens.

3. In an inline electron gun for a cathode-ray tube comprising a modular beam-forming region assembly and at least one main focusing lens attached to at least two insulative support rods, said beam-forming region assembly including three cathode assemblies, a control grid electrode and a screen grid electrode, each of said electrodes having three aligned apertures therethrough for passage of electron beams from said cathode assemblies, said cathode assemblies and said electrodes being individually held in position from a common ceramic member, said ceramic member having a first major surface and an oppositely disposed second major surface with a metallized pattern formed on at least a portion of each major surface, said control grid electrode and said screen grid electrode being attached to said first major surface and said cathode assemblies being attached to said second major surface, wherein the improvement comprises a bimetal transition member attached to said metallized pattern on said first major surface of said ceramic member, said transition member including a substantially flat first part and a second part electrically isolated from said first part, said second part having a flat portion and two upright portions substantially perpendicular to said flat portion and substantially parallel to each other, said control grid electrode being attached to said first part of said transition member, said screen grid electrode comprising three separate plate-like portions, each portion having one of said apertures therein, and a plurality of step-like support members interconnecting each of said plate-like portions of said screen grid electrode and said upright portions of said second part of said transition member, each of said step-like support members including a screen grid electrode contact portion, a bead support contact portion and a central riser portion of precise length extending between said contact portions, said screen grid electrode contact portions being attached to said plate-like portions of said screen grid electrode, said plate-like portions of said screen grid electrode being disposed between said upright portions of said transition member, said central riser portion of each of said support members being adjacent to said upright portions of said transition member and attached thereto, whereby said plate-like portions of said screen grid electrode can be positioned laterally and longitudinally with respect to said control grid electrode and secured in alignment therewith, each of said bead support contact portions being attached to a different one of a plurality of bead support members affixed to said insulative support rods, thereby attaching said screen grid electrode of said modular beam-forming region assembly in longitudinal spaced relation to said main focusing lens.

* * * * *